US005687285A

United States Patent [19]

Katayanagi et al.

[11] Patent Number: 5,687,285

[45] Date of Patent: Nov. 11, 1997

[54] NOISE REDUCING METHOD, NOISE REDUCING APPARATUS AND TELEPHONE SET

[75] Inventors: Keiichi Katayanagi; Masayuki Nishiguchi, both of Kanagawa, Japan

[73] Assignee: Sony Corporation, Tokyo, Japan

[21] Appl. No.: 699,683

[22] Filed: Aug. 14, 1996

Related U.S. Application Data

[63] Continuation of Ser. No. 360,436, Dec. 21, 1994, abandoned.

[30] Foreign Application Priority Data

Dec. 25, 1993 [JP] Japan ..... 5-347469

[51] Int. Cl.[6] ..... G10L 9/00

[52] U.S. Cl. ..... 395/2.35; 395/2.36; 395/2.37; 395/2.42; 381/57; 381/68.4; 381/73.1; 381/94

[58] Field of Search ..... 395/2.35, 2.36, 395/2.37, 2.42; 381/57, 68.4, 73.1, 94

[56] References Cited

U.S. PATENT DOCUMENTS

| | | | |
|---|---|---|---|
| 4,630,305 | 12/1986 | Borth et al. | 381/94 |
| 4,747,143 | 5/1988 | Kroeger et al. | 381/47 |
| 4,847,897 | 7/1989 | Means | 379/390 |
| 4,887,299 | 12/1989 | Cummins et al. | 381/68 X |
| 4,918,734 | 4/1990 | Muramatsu et al. | 381/46 |
| 5,012,519 | 4/1991 | Adlersberg et al. | 381/47 |
| 5,133,013 | 7/1992 | Munday | 381/47 |
| 5,228,088 | 7/1993 | Kane et al. | 381/47 |
| 5,285,502 | 2/1994 | Walton et al. | 381/94 |
| 5,323,337 | 6/1994 | Wilson et al. | 364/574 |
| 5,432,859 | 7/1995 | Yang et al. | 381/94 |
| 5,459,814 | 10/1995 | Gupta et al. | 395/2.42 |

FOREIGN PATENT DOCUMENTS 0459364 12/1991 European Pat. Off. ..... G10L 3/02

OTHER PUBLICATIONS

Clarkson et al., Real-Time Speech Enhancement System Using Envelope Expansion Technique, Electronic Letters, vol. 25 No. 17, Aug. 17, 1989 pp. 1186–1188.

*Primary Examiner*—Allen R. MacDonald
*Assistant Examiner*—Robert Sax
*Attorney, Agent, or Firm*—Jay H. Maioli

[57] ABSTRACT

A noise reducing method and device for reducing the noise contained in an input speech signal collects the speech signal with a microphone 11 and converts the speech signal into a digital input signal x(n) with an A/D converter 12. A frame power calculating circuit 13 calculates a mean frame power rms for each frame of the digital input signal x(n). A suppression ratio calculating circuit 14 calculates different values of the noise suppression ratio depending on the magnitude of the mean frame power rms relative to pre-set threshold values. A level discrimination circuit 18 forms a changeover control signal depending on the noise level and transmits the changeover control signal to the suppression ratio calculating circuit 14 for switching control of the threshold value. The suppression ratio value from the suppression value calculating circuit 14 is transmitted via a smoothing circuit 15 to a noise-reducing circuit 16 and multiplied with the input signal x(n) for reducing the noise component of the speech signal. The effect of the noise-reducing operation is changed in response to the noise level and the intensity of the noise-reducing operation is moderated in portions having a low noise level to prevent deterioration in the sound quality.

17 Claims, 6 Drawing Sheets

NOISE REDUCING METHOD, NOISE REDUCING APPARATUS AND TELEPHONE SET

This is a continuation of application Ser. No. 08/360,436 filed Dec. 21, 1994 now abandoned.

BACKGROUND OF THE INVENTION

1. Field of the Invention

This invention relates to a method for reducing the noise contained in speech signals. More particularly, it relates to a noise reducing method applied to a noise reducing device adapted for reducing the noise admixed into the speech signals collected by a microphone.

2. Description of Related Art

There are known a variety of methods for reducing the noise contained in speech signals. In many of these methods, a sort of an expanding operation is carried out in which, by taking advantage of the fact that noise components are lower in level than speech components, the input signal is processed so that the lower the level of the input signal, the larger the amount of attenuation of the input signal.

The extent of expansion, that is, the expansion ratio, is selected to be a moderate value so that the expansion is neither too strong nor too weak, taking into account that the extent of expansion enables the noise components under the usual state to be reduced effectively.

In such method of reducing the noise by expansion, there may be occasions wherein the effect of noise reduction is insufficient where there is a high level of noise contained in the input signal. Conversely, if no noise is contained in the input signal, consonant sounds, such as "sa", "si", "su", "se" and "so" are extinguished by expansion, thus producing an unnatural sound. That is, expansion is carried out even in such cases wherein the noise is small and there is no necessity of carrying out the noise reducing operation, thus leading to deteriorated sound quality.

With the above-described noise-reducing method, since the expanding effect becomes greater the smaller the input signal level, the sound tends to be erased or emitted when expansion is made in combination with a speech coder that mutes a signal below a certain constant level, for example, a signal not higher than −66 dB, thus giving unnatural sounding speech on decoding.

SUMMARY OF THE INVENTION

In view of the foregoing, it is an object of the present invention to provide a noise reducing method whereby the noise may be reduced without deteriorating the sound quality of the reproduced speech signal so that more natural sounding playback sound may be produced.

According to the present invention, there is provided a method for reducing the noise contained in an input speech signal comprising the steps of detecting the level of a noise component contained in the input speech signal for forming a control signal depending on the detected noise level, and modifying the contents of the noise reducing operation for the input speech signal depending on the control signal for carrying out the modified noise reducing operation.

The contents of the noise-reducing operation, modified depending on the control signal, preferably include changing the threshold value of the input signal level for level expansion. That is, if the input signal level is below a pre-set threshold value and level expansion is to be performed for noise reduction, the threshold value is changed or switching-controlled depending on a control signal generated on the basis of the noise level detected by the noise level detection step.

The noise reducing operation may be performed in accordance with an input/output characteristic curve which represents an output signal level in dB to the input signal level in dB and which is in the shape of a kinked line having two or more kinked points. For example, a first threshold value and a second threshold value smaller than the first threshold value are set for the input signal level, and level expansion for noise reduction is performed only when the input level is in a range of from the first threshold value to the second threshold value, while level expansion is not performed and fixed attenuation is used when the input level is smaller than the second threshold value. In this manner, if the noise reducing device is to be used in combination with a device adapted for muting a signal lower than a pre-set level, the phenomenon of the sound being indistinctly produced or muted may be prevented from occurring to resolve the unnatural sounding impression.

The contents of the noise reducing operation may also be modified by providing for plural noise-reducing algorithms and changing over these algorithms depending on the control signal. To this end, three noise reducing algorithms, that is, a first noise reducing algorithm of calculating a suppression ratio depending on the level of said input speech signal level and multiplying the input speech signal with the calculated suppression ratio, a second noise reducing algorithm of calculating a suppression ratio depending on the level of a signal corresponding to the input speech signal the high-frequency component of which is enhanced and multiplying the signal with the calculated suppression ratio, and a third noise reducing algorithm of performing a noise-reducing operation only on the low-frequency component of the input speech signal and adding the noise-reduced low-frequency component to the high-frequency component of the input speech signal, may be provided and one of these algorithms selected depending on the control signal. In this manner, the effect of the noise-reducing operation may be moderated by switching depending on the noise level in such a manner that the noise is reduced intensively in a place where the surrounding noise level is high, thereby further improving the noise-reducing effect.

With the method of the present invention, the effect of the noise reducing operation may be changed over depending on the background noise level for adjustment to an optimum value of the noise reduction. Specifically, the expansion is suppressed for the low background noise level for preventing deterioration in the sound quality.

DETAILED DESCRIPTION OF THE PREFERRED EMBODIMENTS

Figure 1:
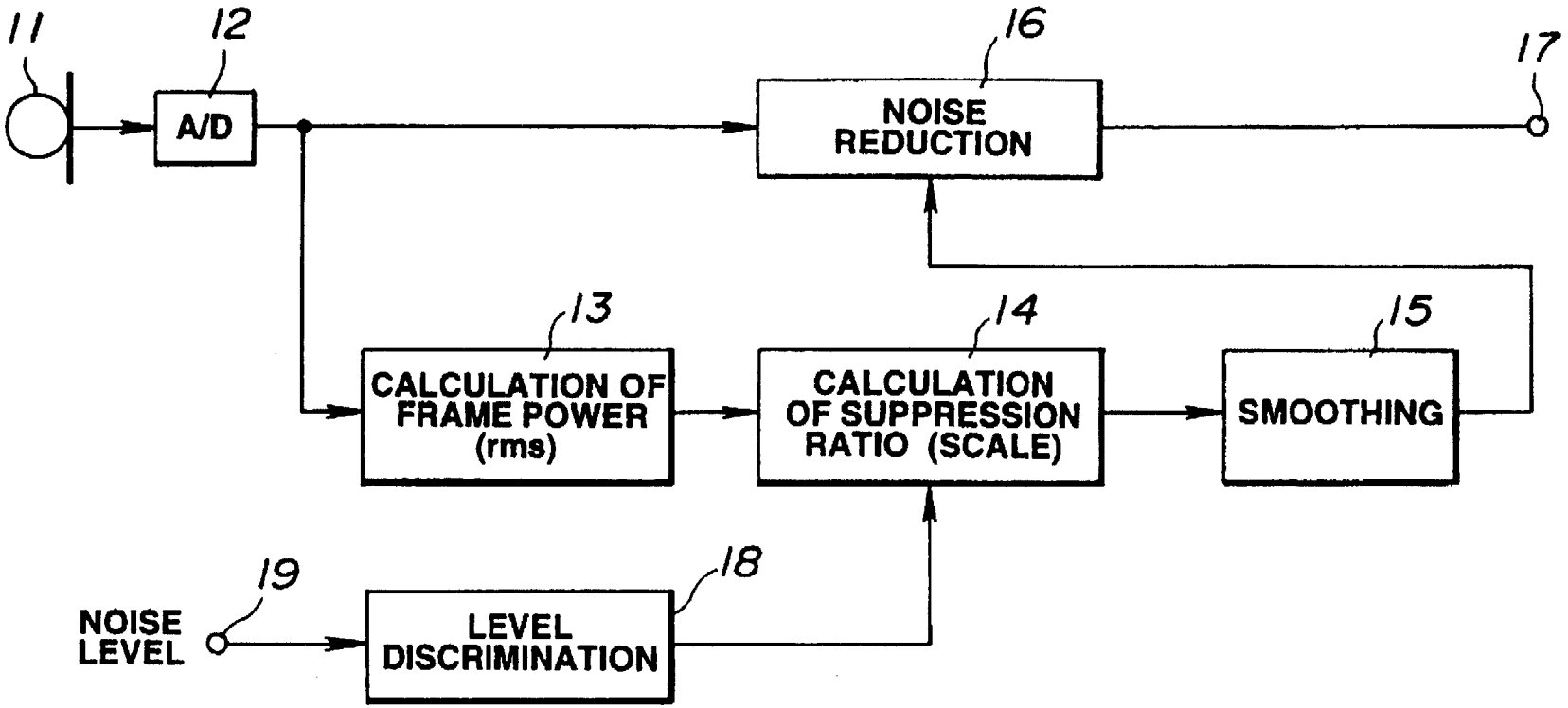
FIG. 1 is a block circuit diagram showing a noise reducing device for carrying out the noise reducing method according to a first embodiment of the present invention.

Referring to the drawings, certain preferred embodiments of the noise reducing method according to the present invention will be explained in detail. In the following explanation, it is assumed that a noise reducing device for carrying out the method of these embodiments is built into a portable telephone device. That is, assuming that the portable telephone device is used under a high-noise environment, the method of reducing the noise according to the embodiments of the present invention is applied to a noise reducing device for reducing the noise collected by a microphone along with the speech.

FIG. 1 shows a noise reducing device to which the noise reducing device according to a first embodiment of the present invention is applied.

In FIG. 1, a microphone 11 is employed as speech signal input means. This microphone collects not only the speech but also the noise such as external sound, wind or the like which is converted along with the speech into electrical signals.

An input signal from the microphone 11 is supplied to an analog/digital (A/D) converter 12 for converting the analog signal into a digital signal. The digital input signal x(n) from the A/D converter 12 is divided by frame forming means, not shown, into a plurality of frames each being of a period of 20 msec and each being made up of 160 samples. The digital input signal is supplied frame-by-frame to a frame power calculating circuit 13 and a noise reducing circuit 16. The frame power calculating circuit 13 calculates, as the frame-based power of the speech signal, the mean power, for example, the root mean square (RMS) value, of the frame-based digital input signal x(n). The frame-based mean power value, calculated by the frame power calculating circuit 13, is supplied to a suppression ratio calculating circuit 14. The suppression ratio calculating circuit 14 calculates, using the mean frame power as calculated by the frame power calculating circuit 13, a suppression ratio which is a coefficient for noise suppression. The suppression ratio as found by the suppression ratio calculating circuit 14 is transmitted to a smoothing circuit 15 which smoothes the suppression ratio as found by the suppression ratio calculating circuit 14. By the term smoothing is meant the processing for eliminating discontinuous junction points in the input speech signal divided on the frame basis. The suppression ratio, thus smoothed, is transmitted to a noise reducing circuit 16 so as to be used therein for eliminating the noise in the digital input signal x(n) supplied from the A/D converter 12.

The suppression ratio calculating circuit 14 is fed with a control signal obtained by discriminating the noise level detection signal entering a terminal 19 by a level discrimination circuit 18. The threshold value for calculating the suppression ratio, for example, is changed over depending on this control signal.

The frame power calculating circuit 13 calculates the frame-based mean power of the digital input signal x(n). The mean power rms of each 160-sample frame of the digital input signal x(n) is calculated by equation (1):

$$rms = \sqrt{\frac{1}{160}\sum_{n=0}^{159} x^2(n)} \tag{1}$$

The mean power rms, calculated on basis of the equation (1), is supplied to the suppression ratio calculating circuit 14.

The suppression ratio calculating circuit 14 compares the mean power rms to a certain threshold nr1 and, based on the results of comparison, calculates a suppression ratio (scale). That is, the suppression ratio (scale) is set to unity if the mean power rms is greater than or equal to nr1, and to $$\text{scale}=rms/K \tag{2}$$

if the mean power rms is less than the threshold value nr1. In the above equation, K denotes a constant and is equal to nr1 (K=nr1) in the present embodiment. Alternatively, the suppression ratio (scale) is calculated by equation (2) for all of the rms values and, if the suppression ratio (scale), which is the result of calculations, is less than unity (scale<1), the digital input signal x(n) is multiplied by the suppression ratio (scale) calculated by equation (2). This is tantamount to multiplying the digital input signal x(n) by a gain less than unity for a frame in which the mean power rms is less than the threshold value nr1. If, as a result of the calculations of equation (2), the suppression ratio becomes greater than or equal to unity (scale≧1), the digital input signal x(n) is output directly, that is, without any processing. This is tantamount to multiplying the digital input signal x(n) by a gain equal to unity for a frame in which the suppression ratio (scale) becomes equal to the threshold value. Thus, by suitably selecting the threshold value nr1, the gain is controlled to a smaller value for a small power portion, such as a noise portion, thus effectively achieving the noise reduction. The effect of noise suppression in case of employing equation (2) becomes equal to ½ of the mean power of the input signal.

If the noise suppression is too intense or if the circuit for muting the sound lower than a pre-set level is used in combination, it is preferred to set a second threshold value nr2 smaller than the threshold value nr1, which is to be the first threshold, and to lower the suppression, that is, to moderate the intensity of the expanding operation of an expander, for a region in which the input level becomes smaller than the second threshold value nr2.

Figure 2:
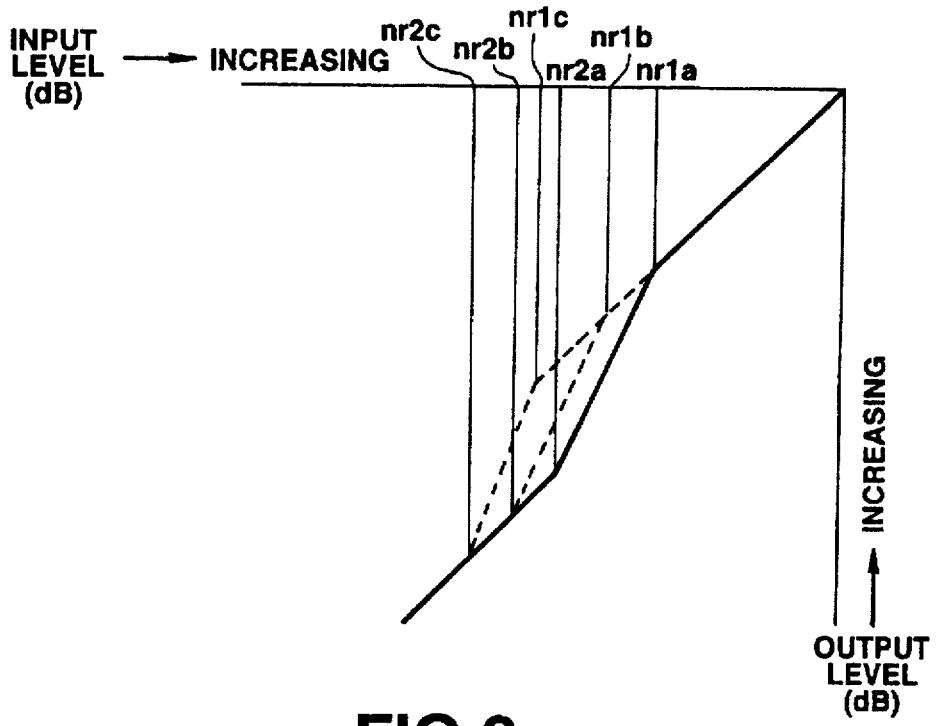
FIG. 2 is a graph showing an illustrative relationship between input and output signals when the noise reduction is performed using a noise suppression ratio from a suppression ratio calculating circuit from a noise reducing device shown in FIG. 1.

FIG. 2 shows typical input/output characteristics in the case of reducing the effect of noise suppression in an input level region smaller than the second threshold value nr2. In this case, the output signal is obtained by multiplying the digital input signal x(n) by the suppression ratio value as found by the suppression ratio calculating circuit 4. In FIG. 2, the input and output levels are plotted in dB on the abscissa and on the ordinate, respectively.

In FIG. 2, there is shown an instance of expander characteristics in which, for the domain in which the above rms value indicating the input level, for example, is greater than or equal to a first threshold value nr1a on the abscissa, the gain is set to unity and, for the domain in which the input level becomes smaller than nr1a, the gain becomes smaller with a decrease in the input level. On the other hand, for the domain in which the input level becomes smaller than a second threshold value nr2a lower than the first threshold value nr1a, the gradient of the curve is restored to the above-stated gradient corresponding to the unity gain, for example, or a fixed amount of attenuation. That is, for the domain in which the input level becomes smaller than the second threshold value nr2a, a fixed value of the suppression ratio $$(\text{suppression ratio})=nr2/nr1 \quad (3)$$

independent of the rms value is used and multiplied with the input signal to give an output signal having the constant amount of attenuation. In such case, the input/output characteristic curve, representing the output signal level in dB relative to the input signal level similarly in dB, is represented as a kinked line having two kinked points corresponding to the two threshold values nr1a and nr2a. This diminishes the unnatural sound impression in the speech produced on noise suppression.

Besides, in FIG. 2, a plurality of, herein three, sets of each of the first and second threshold values nr1, nr2, that is, nr1a, nr2a, nr1b, nr2b, nr1c and nr2c, are pre-set and one of these sets of the threshold values is selected depending on a control signal produced on the basis of a noise level detection signal as later explained.

That is, for a noise level A as detected by, for example, a noise level detection circuit, two threshold values th1, th2 are set, where th1>th2. These threshold values th1, th2 are set on a level discrimination circuit 18 as discrimination values. The level discrimination circuit 18 discriminates the noise level A from a terminal 19 by the threshold values th1, th2 and generates a changeover control signal which will select the set of the threshold values nr1a, nr2a for A≧th1, the set of the threshold values nr1b, nr2b for th1>A≧th2 and the set of the threshold values nr1c, nr2c for th2>A. The suppression ratio calculating circuit 14 selects one of the sets of the threshold values associated with the changeover control signal and, depending on the selected set of the threshold values, the suppression ratio calculating circuit 14 discriminates the mean frame power rms as the input level and calculates the noise suppression ratio.

This is tantamount to changing over the threshold of application of the noise suppression in a plurality of stages responsive to the detected noise level to increase or decrease the threshold value when the environment is loud or quiet, respectively. Thus the extent of noise reduction is changed depending on the strength of the background noise at the site of telephone call so that the effect of noise reduction is decreased in a quiet environment for obviating the unnatural sound impression due to the noise suppression and so that the effect of noise reduction is intensified in a loud environment for sufficiently decreasing the noise.

Assuming that the mean speech power rms over a frame of 20 msec is to be found by the above equation (1), with the maximum amplitude for the 16-bit digital signal data being 32767, the practical values of the threshold values of nr1a=1024, nr2a=512, nr1b=512, nr2b=256, nr1c=256 and nr2c=128 suffice. For the rms value of 512, the threshold value corresponds to approximately −33 dB for the full-scale sine wave of 0 dB.

On the other hand, if the threshold values th1, th2 of the background noise level A are expressed by the mean power over one frame as in the case of the rms, th1 and th2 can be set to 112 and 48, respectively (th1=112 and th2=48). These values correspond to the background noise levels of 70 dBA (about −40 dB) and 50 dBA, respectively.

Figure 3:
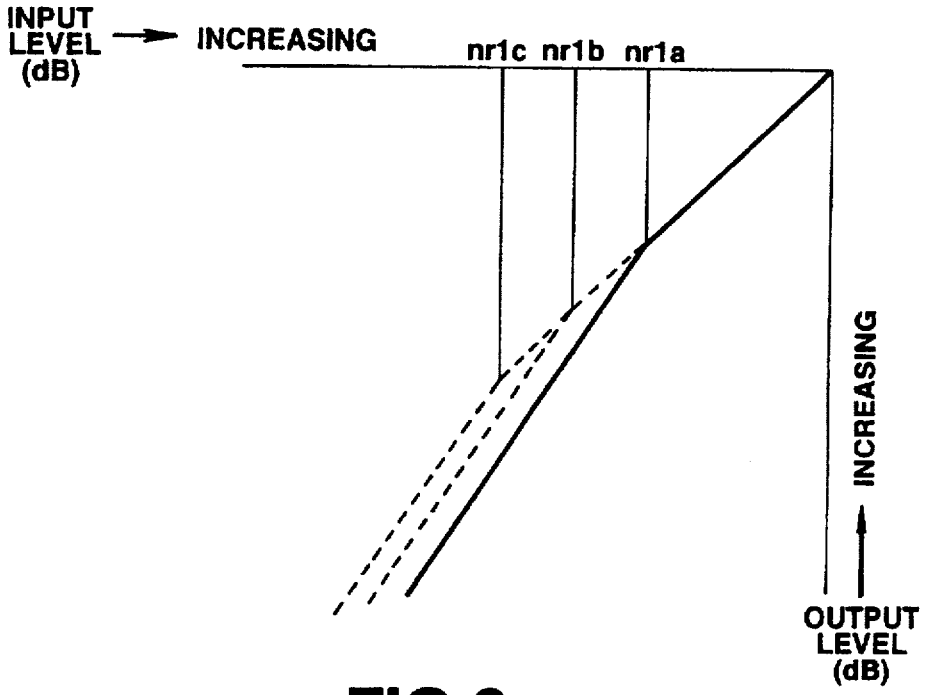
FIG. 3 is a graph showing another illustrative relationship between input and output signals when the noise reduction is applied using a noise suppression ratio from a suppression ratio calculating circuit from a noise reducing device shown in FIG. 1.

It is also possible to employ input/output characteristics in the form of kinked lines each having one kinked point, and to select the threshold values of the kinked lines nr1a, nr1b and nr1c on the basis of the above noise level. The ordinate and the abscissa of FIG. 3 are the same as those of FIG. 2. The suppression ratio of the region lower in level than the threshold values of the kinked lines of FIG. 3 can be calculated from the above equation (2).

In addition, in a region wherein the input level is lower than the second threshold value nr2 smaller than the first threshold value nr1, an equation for calculation of the suppression ratio value $$(\text{suppression ratio})=rms^2/K' \quad (3')$$

where K' is a constant, may be employed for further enhancing the noise suppression, that is, for raising the expander operation. The noise suppression effect at this time is one-fourth of the mean power of the input signal.

Meanwhile, since the speech portion and the noise portion in the input signal are not processed separately, the tendency is for the speech to become absent in the region where the speech power in, for example, the consonants, is smaller. This tendency becomes pronounced when the noise reduction is applied most strongly, such that a very unnatural sound impression is produced depending on the speech type. Consequently, it becomes necessary to determine what strength of the noise reduction relative to the mean frame power is to be used or from which value of the input signal the noise reduction is to be applied. In the above embodiment of FIG. 2, this phenomenon is prevented from occurring by changing the intensity of noise reduction in two stages depending on the input level.

On the other hand, if the above processing is performed frame-by-frame, the speech junction becomes non-conjunctive at the speech frames to produce an unnatural sound impression.

In this consideration, it may be contemplated to set the attack time or the recovery time for the suppression ratio value and to carry out the smoothing on the frame basis to eliminate the unnatural sound impression.

In the arrangement shown in FIG. 1, the suppression ratio value as found by the suppression ratio calculating circuit 14 is smoothed by the smoothing circuit 15 before being transmitted to the noise reducing circuit 16.

The smoothing circuit 15 is provided for overcoming the problem induced in noise reduction as mentioned above, and sets the attack time and the recovery time. In the present embodiment, the attack time is set to "0" and the recovery time may be changed.

That is, if the speech power of the current frame as calculated is greater than that of the previous frame, the calculated frame power is directly employed. Conversely, if the speech power is less, it is smoothed by a low-pass filter (LPF) whose characteristics are shown in equation (4)

$$S(n)=Scale_flt_1\times S(n-1)+Scale_flt_2\times scale \quad (4)$$

in order to eliminate the unnatural sound impression of the processed speech caused by changes in the frame power.

The recovery time can be changed by changing the proportions of the coefficients scale-$flt_1$, scale-$flt_2$. If smoothing is performed in accordance with equation (4), the recovery portion, above all, in the changing portion in the input speech can be changed smoothly. The suppression ratio value smoothed by the smoothing circuit 15 so as to be corrected for the unnatural sound impression in the processed speech due to changes in the frame power is supplied to a noise reducing circuit 16.

The noise reducing circuit 16 multiplies the digital input signal x(n) supplied from the A/D converter 12 with the suppression ratio value supplied from the smoothing circuit 15 for outputting a noise-reduced output signal at an output terminal 17.

It is thus possible with the noise reducing device employing the noise reducing method according to the present first embodiment to carry out the noise reducing operation with a smaller signal processing quantity. On the other hand, since the input/output characteristics as shown in FIG. 2 are used, and the expanding operation is stopped at a minute input signal level less than the second threshold value, a more natural sounding playback sound is produced. Besides, since noise suppression operates only weakly where the environmental noise level is low, so that the expander is not in operation unnecessarily deterioration in sound quality is prevented. Conversely, the expander operation may be intensified where the environmental noise level is higher, thereby further enhancing the noise suppression effect.

Figure 4:
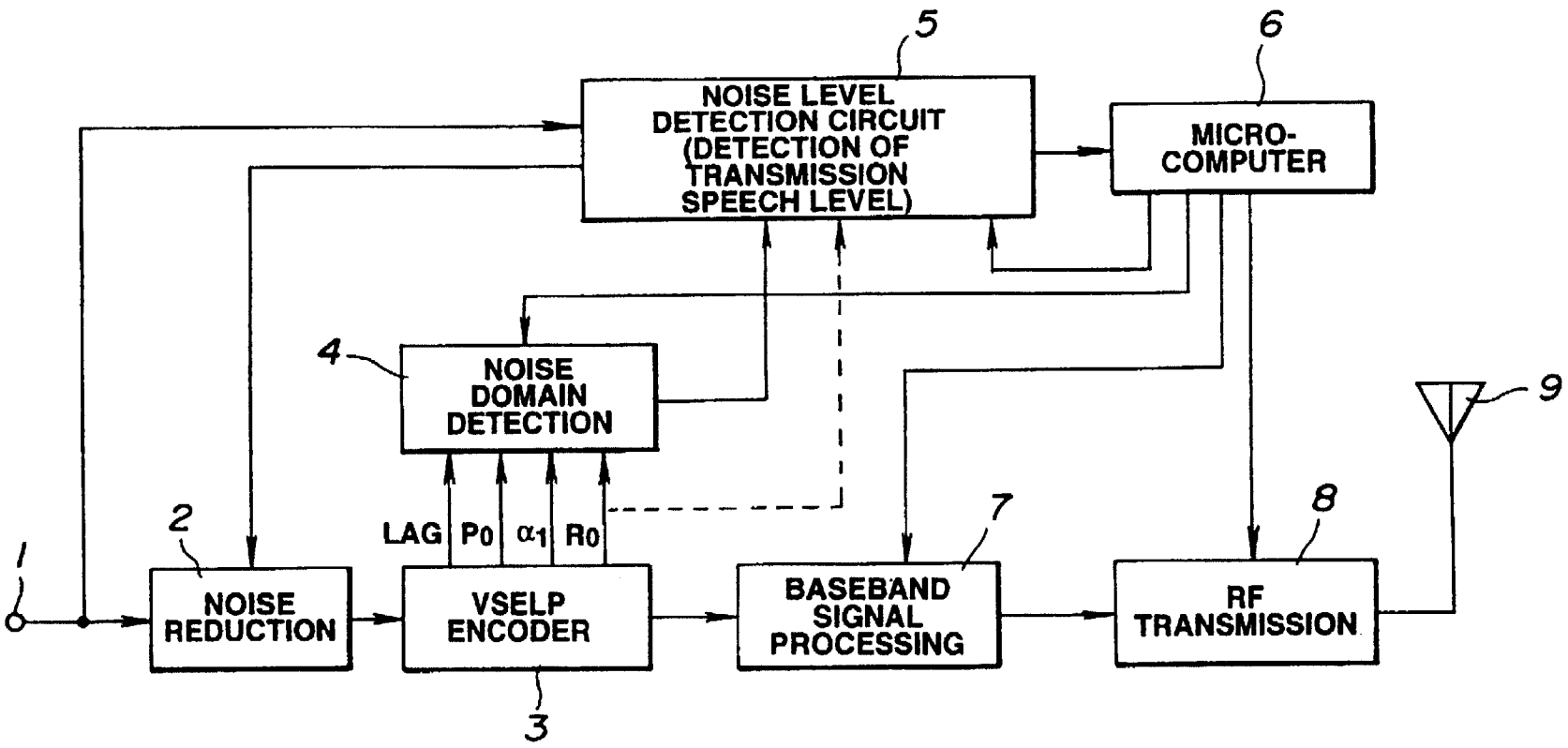
FIG. 4 is a block circuit diagram showing an example of a circuit arrangement of a speech transmitting device employing the noise reducing device shown in FIG. 1.

The above-described noise reducing device may be employed in, for example, a speech signal transmitting device shown in FIG. 4. Such speech signal transmitting device is employed as a transmitting portion of a portable telephone device, and resorts to vector sum excited linear prediction (VSELP) for a speech coding method for compression of transmission data.

The technical contents of VSELP is disclosed in U.S. Pat. No. 4,817,157. This technique is a technique related to the code excited linear prediction (CELP). With the VSELP encoder, parameters such as the speech frame power, reflection and linear prediction coefficients, pitch frequency, codebook, pitch or the codebook gain, are analyzed, and the speech is encoded using these analytic parameters. A variety of speech encoding techniques may naturally be employed in addition to the VSELP.

In FIG. 4, the input speech signal is collected by the above-mentioned microphone and converted by the A/D converter into a digital signal which is supplied to an input terminal 1. This input digital speech signal is supplied via the noise reducing circuit 2 shown in FIG. 1 to a vector sum exited linear prediction (VSELP) encoder 3. The noise reducing circuit 2 may be made up of, for example, the frame power calculating circuit 13, the suppression ratio calculating circuit 14, the smoothing circuit 15, the noise reducing circuit 16 and the level discrimination circuit 18 shown in FIG. 1.

The porion of the circuit shown in FIG. 4 generating the transmission signal is comprised of the VSELP encoder 3, a noise domain detection circuit 4 for detecting the background noise level using analytic parameters detected by the noise domain detection circuit 4 and a micro-computer 6 for controlling the volume of the received sound responsive to the noise level as detected by the noise level detection circuit 5.

With the speech encoding method employing the above-described VSELP encoder, high-quality speech transmission at a low bit rate is achieved by a codebook search by analysis-by-synthesis. With a speech encoding device for carrying out the speech encoding method employing the VSELP, that is, a vocoder, the pitch or the like, as a characteristic of input speech signals, is excited by selecting the code vector stored in the codebook for encoding the speech. The parameters employed for encoding, such as the pitch frequency, include the frame power, reflection coefficients, linear prediction coefficients, codebook, pitch and codebook gain.

Among these analytic parameters, the frame power $R_0$, pitch gain $P_0$ indicating the degree of strength of the pitch component, linear prediction coding coefficient $\alpha_1$ and the lag LAG of the pitch frequency, are employed for detecting the background noise. The frame power $R_0$ is utilized because the speech level becomes equal to the noise level only on extremely rare occasions, while the pitch gain $P_0$ is utilized because the environmental noise, assumed to be random, is thought to have the speech pitch only on extremely rare occasions.

On the other hand, the linear prediction encoding coefficient $\alpha_1$ is employed since which one of the high-frequency component or the low-frequency component is stronger can be determined depending on whether the value of $\alpha_1$ is large or small, respectively. The background noise is usually concentrated in the high-frequency region, and the background noise can be detected from the linear prediction encoding coefficient $\alpha_1$. This linear prediction encoding coefficient $\alpha_1$ is the sum of coefficients of inverse functions $Z_{-1}$ resulting from resolution of the direct higher-order FIR filter into a cascade of second-order FIR filters. Consequently, if the zero point $\Theta$ is in a range of $0<\Theta<\pi/2$, the linear prediction encoding coefficient $\alpha_1$ becomes larger. Consequently, it may be said that, should $\alpha_1$ be larger or smaller than a pre-set threshold value, the signal energy is concentrated in a lower range and in a higher range, respectively.

The relation between the zero point $\Theta$ and the frequency will now be explained.

If the sampling frequency is set to f, the frequency of 0 to f/2 corresponds to the frequency of 0 to $\pi$ in a digital system, such as a digital filter. If the sampling frequency f is set to, for example, 8 kHz, the frequency 0 to 4 kHz corresponds to the frequency of 0 to $\pi$, so that $\pi/2$=2 kHz. Consequently, the smaller the value of $\Theta$, the lower becomes the frequency range. On the other hand, the smaller the value of $\Theta$, the larger becomes the value of $\alpha_1$. Thus, which one of the low-frequency component or the high frequency component is stronger can be determined by checking the relationship between the value of $\alpha_1$ and the pre-set threshold value.

The noise domain detection circuit 4 receives the above-mentioned analytic parameters, that is, the frame power $R_0$, the pitch gain indicating the degree of intensity of the pitch component, the linear prediction encoding coefficient $\alpha_1$ and the lag LAG in the pitch frequency, from the VSELP encoder 3, for detecting the noise domain. This is effective in avoiding the increase in the processing quantity since there is a limitation imposed on the size of the digital signal processor (DSP) or the memory in order to accommodate the tendency towards reduction in size of the portable telephone device.

The noise level detection circuit 5 detects the speech level, that is, the transmission speech level, in the noise domain detected by the noise domain detection circuit 4. The detected transmission speech level may be the value of the frame power $R_0$ of the frame ultimately judged to be the noise domain by the noise domain detection circuit based on evaluation employing the analytic parameters. However, since there is the possibility of mistaken detection, the frame power $R_0$ is routed to a 5-tap minimum value filter, as will be explained subsequently.

The micro-computer 6 controls the timing of the noise domain detection by the noise domain detection circuit 4 and the timing of the noise level detection by the noise level detection circuit 5, while controlling the volume of the playback speech responsive to the noise level.

In the above-described arrangement of FIG. 4, the digital speech input signal from the input terminal 1 is routed to the noise reducing circuit 2 where noise reduction is carried out as explained in connection with FIGS. 1 and 2. The digital speech input signal thus processed is then supplied to the VSELP encoder 3, which then analyzes the input signal, now digitized, and proceeds to information compression and encoding. At this time, the analytic parameters such as the frame power, reflection coefficient, linear prediction coefficient, pitch frequency, codebook, pitch and the codebook gain of the input speech signal, are employed.

The data compressed and encoded by the VSELP encoder 3 is fed to a baseband signal processing circuit 7 where the synchronization signal, framing and error correction signal are appended to the data. Output data of the baseband signal processing circuit 7 is fed to an RF transmission and reception circuit 8 where the data is modulated to a suitable frequency for transmission over an antenna 9.

Among the analytic parameters employed by the VSELP encoder 3, the frame power $R_0$, the pitch gain indicating the degree of intensity of the pitch component, the linear prediction encoding coefficient $\alpha_1$ and the lag LAG in the pitch frequency, are supplied to the noise domain detection circuit 4. The noise domain detection circuit 4 detects the noise domain using the frame power $R_0$, the pitch gain indicating the degree of intensity of the pitch component, the linear prediction encoding coefficient $\alpha_1$ and the lag LAG in the pitch frequency. The information ultimately determined to be the noise domain by the noise domain detection circuit 4, that is, the flag information, is supplied to the noise level detection circuit 5.

The noise level detection circuit 5 is also fed with the digital input signal from the A/D converter 2 and detects the signal level of the noise domain responsive to the flag information. The signal level may be the frame power $R_0$ as mentioned above.

The noise level data detected by the noise level detection circuit 5 is supplied to the micro-computer 6 as a controlling part, the data also being fed to the noise reducing circuit 2. In the noise reducing circuit 2, the noise level data is supplied via a terminal 19 shown, for example, in FIG. 1 to the level discrimination circuit 18 where the changeover control signal subject to level discrimination by the threshold values th1 and th2 is formed for switching selection of the threshold value of the input level by the suppression ratio calculating circuit 14.

Detection of the noise level by the noise level detection circuit 5 according to the present embodiment will now be explained.

First, the domain in which to detect the noise level needs to be a noise domain as detected by the noise level detection circuit 4. The timing of detecting the noise domain is controlled by the controller 6, as explained previously. The noise domain detection is performed in order to assist the noise level detection by the noise level detection circuit 5. That is, determination is made as to whether a frame under consideration is a voiced sound or the noise. If the frame is determined to be a noise, it becomes possible to detect the noise level. As a matter of course, detection of the noise level may be achieved more accurately if there exists only the noise. Consequently, the speech level entering the transmitting microphone 1 in the absence of the transmitted speech input is detected by the noise level detection circuit 5 as transmitted speech level detection means.

An initial value of the noise level of −20 dB is first set with respect to a sound volume level as set by the user. If the noise level detected in a manner as later explained is determined to be greater than the initial set value, the playback sound volume level on the receiving side is increased.

The noise level can be detected easily if the frame-based input voice sound is within the background noise domain. For this reason, the sound received directly after the turning on of the transmitting power source of the transmitting section, the sound received during the standby state for a reception signal of the transmitting section, and the sound received during a call with the sound level at the receiving side being lower than a pre-set level, is regarded as being the background noise, and detection is made of the frame noise level during this time.

The transmitting call power source of the transmitting section being turned on is an indication that the user is willing to start using the present portable telephone set. In the present embodiment, the inner circuitry usually makes a self-check. When next the user stretches out the antenna 9, the telephone set enters the standby state, after verifying that the interconnection with a base station has been made. Since the input voice sound from the user is received only after the end of the series of operations, there is no likelihood that the user utters the voice sound to the microphone during this time. Consequently, if the transmitting microphone 1 is used during this series of operations, the detected sound level is the surrounding noise level, that is, the background noise level. Similarly, the background noise level may be detected during or directly after the user has made a transmitting operation (dialing operation) directly before starting the call.

The standby state for a reception signal of the transmitting section means the state in which the call signal from the called party is being awaited with the power source of the receiving section having been turned on. Such state is not the actual call state, so that it may be assumed that there is no voice sound of conversation between the parties. Thus the background noise level may be detected if the surrounding sound volume level is measured during this standby state using the transmitting microphone. It is also possible to make such measurements a number of times at suitable intervals and to average the measured values.

It is seen from above that the background noise level may be estimated from the sound level directly after the turning on of the transmitting power source of the transmitting section, and the sound received during the standby state for a reception signal of the transmitting section, and conversation may be started subject to speech processing based upon the estimated noise level. It is, however, preferred to follow subsequent changes in the background noise level dynamically even during the conversation over the telephone. For this reason, the background noise level is detected responsive also to the speech level at the receiving section during talk over the telephone.

It is preferred that such detection of the noise level on the receiving section during the conversation be carried out after detecting the noise domain by the analytic parameters employed by the receiving side VSELP encoder 3, as explained previously.

Since noise detection may be made more accurately when the level of the monitored frame power $R_0$ is higher than a reference level or when the called party is talking, the reproduced sound volume when the called party is talking may be controlled on the real time basis thereby realizing more agreeable call quality.

Thus, in the present embodiment, the controller 6 controls the detection timing of the noise domain detection circuit 4 and the noise level detection circuit 5 so that detection will be made directly after turning on of the transmitting power source of the transmitting section, during the standby state of reception signals of the transmitting section and during talk over the telephone set when the Voice sound is interrupted.

The operation of detecting the noise domain by the noise domain detection circuit 4 will now be explained by referring to the flow chart shown in FIGS. 5 and 6.

Figure 5:
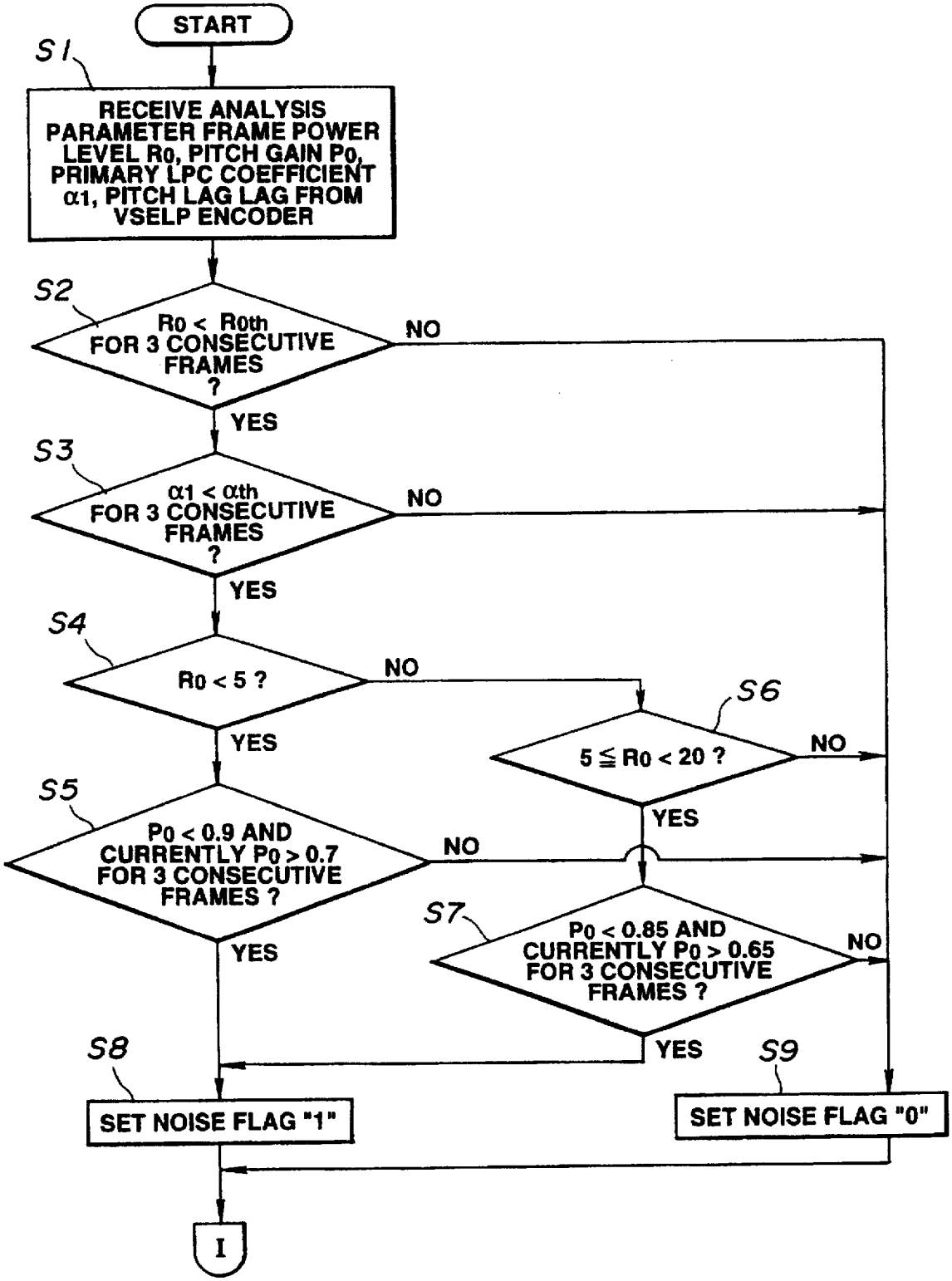
FIG. 5 is a flow chart for illustrating the former half portion of the operation of the noise detection circuit of the noise reducing device shown in FIG. 1.

After the flow chart of FIG. 5 is started, the noise domain detection circuit 4 receives the frame power $R_0$, pitch gain $P_0$ indicating the magnitude of the pitch component, first-order linear prediction coefficient $\alpha_1$ and the lag of the pitch frequency LAG from the VSELP encoder 3.

In the present embodiment, determination in each of the following steps by the analytic parameters supplied at the step S1 is given in basically three frames because such determination given in one frame leads to frequent errors. If the ranges of the parameters are checked over three frames, and the noise domain is located, the noise flag is set to 1. Otherwise, the error flag is set to 0. The three frames comprise the current frame and two frames directly preceding the current frame.

Determinations by the analytic parameters through these three consecutive frames are given by the following steps.

At a step S2, it is checked whether the frame power $R_0$ of the input voice sound is lower than a pre-set threshold $R_{0th}$ for the three consecutive frames. If the determination result is YES, that is if $R_0$ is smaller than $R_{0th}$ for three consecutive frames, processing transfers to a step S3. If the determination result is NO, that is, if $R_0$ is larger than $R_{0th}$ for the three consecutive frames, processing transfers to a step S9. The preset threshold $R_{0th}$ is the threshold for noise, that is, a level above which the sound is deemed to be a voice instead of the noise. Thus the step S2 is carried out in order to check the signal level.

At a step S3, it is checked whether the first-order linear prediction coefficient $\alpha_1$ of the input voice sound is smaller for three consecutive frames than a pre-set threshold $\alpha_{the}$. If the determination result is, YES, that is if $\alpha_1$ is smaller than $\alpha_{the}$ for three consecutive frames, processing transfers to a step S4. Conversely, if the determination result is, NO, that is if $\alpha_1$ is larger than $\alpha_{the}$ for three consecutive frames, processing transfers to a step S9. The pre-set threshold $\alpha_{the}$ has a value which is scarcely manifested at the time of noise analysis. Thus the step S3 is carried out in order to check the gradient of the speech spectrum.

At a step S4, it is checked whether the value of the frame power $R_0$ of the current input speech frame is smaller than 5. If the determination result is YES, that is, if $R_0$ is smaller than 5, control proceeds to a step S5. Conversely, if the determination result is NO, that is, if $R_0$ is larger than 5, control proceeds to a step S6. The reason the threshold is set to 5 is that the possibility is high that a frame having a frame power $R_0$ larger than 5 is a voiced sound.

At a step S5, it is checked whether the pitch gain $P_0$ of the input speech signal is smaller than 0.9 for three consecutive frames and the current pitch gain $P_0$ is larger than 0.7. If the determination result is YES, that is if it is found that the pitch gain $P_0$ is smaller than 0.9 or three consecutive frames and the current pitch gain $P_0$ is larger than 0.7, control proceeds to step S8. Conversely, if the determination result is NO, that is, if it is found that the pitch gain $P_0$ is larger than 0.9 for three consecutive frames and the current pitch gain $P_0$ is larger than 0.7, control proceeds to a step S8. The steps S3 to S5 check the intensity of pitch components.

At a step S6, it is checked, responsive to the negative determination results at the step S4, that is, that $R_0$ is 5 or larger, whether the frame power $R_0$ is not less than 5 and less than 20. If the determination result is YES, that is, if $R_0$ is not less than 5 and less than 20, control proceeds to a step S7. If the determination result is NO, that is, if $R_0$ is not in the above range, control proceeds to a step S9.

At the step S7, it is checked whether the pitch gain $P_0$ of the input speech signals is smaller than 0.85 for three consecutive frames and the current pitch gain $P_0$ is larger than 0.65. If the determination result is YES, that is, if the pitch gain $P_0$ of the input speech signals is smaller than 0.85 for three consecutive frames and the current pitch gain $P_0$ is larger than 0.65, control proceeds to a step S8. Conversely, if the determination result is NO, that is, if the pitch gain $P_0$ of the input speech signals is larger than 0.85 for three consecutive frames and the current pitch gain $P_0$ is smaller than 0.65, control proceeds to a step S9.

At the step S8, responsive to the determination result of YES at the step S5 or S7, the noise flag is set to 1. With the noise flag set to 1, the frame is set as being the noise.

If the determination results given at the steps S2, S3, S5, S6 and S7 are NO, the noise flag is set at the step S9 to 0, and the frame under consideration is set as being the voice sound.

Figure 6:
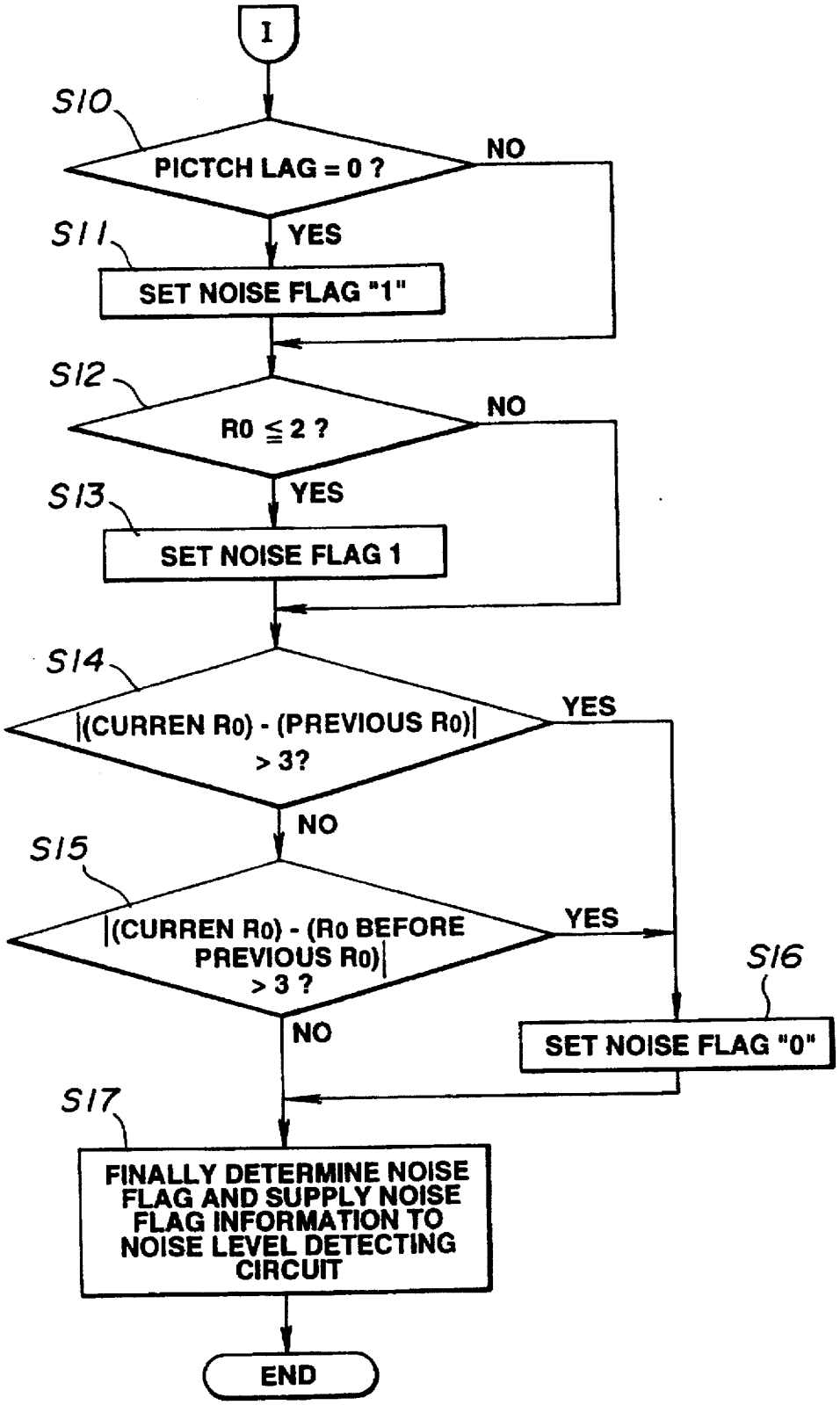
FIG. 6 is a flow chart for illustrating the former half portion of the operation of the noise detection circuit of the noise reducing device shown in FIG. 1.

The steps S10 et seq. are shown in the flow chart of FIG. 6.

At a step S10, a determination is made as to whether or not the pitch lag LAG of the input speech signal is 0. If the determination result is YES, that is, if LAG is 0, the frame is set as being the noise because there is little possibility of the input signal being the voice sound for the pitch frequency LAG equal to 0. That is, control proceeds to a step S11 and sets a noise flag to 0. If the determination result is NO, that is, if LAG is not 0, control proceeds to a step S12.

At the step S12, it is checked whether the frame power $R_0$ is 2 or less. If the determination result is YES, that is, if $R_0$ is 2 or less, control proceeds to a step S13. If the determination result is NO, that is, if $R_0$ is larger than 2, control proceeds to a step S14.

At the step S12, it is checked whether the frame power $R_0$ is 2 or less. If the determination result is YES, that is, if $R_0$ is 2 or less, control proceeds to a step S13. If the determination result is NO, that is, if $R_0$ is larger than 2, control proceeds to a step S14. At the step S13, it is checked whether the frame power $R_0$ is significantly small. If the determination result is YES, the noise flag is set to 1 during the next step S13, and the frame is set as being a noise.

At the step S13, similarly to the step S11, the noise flag is set to 1, in order to set the frame as being the noise.

At the step S14, the frame power $R_0$ of a frame immediately previous to the current frame is subtracted from the frame power $R_0$ of the current frame, and it is checked whether the absolute value of the difference exceeds 3. The reason is that, if there is an acute change in the frame power $R_0$ between the current frame and the temporally previous frame, the current frame is set as being the voice sound frame. That is, if the determination result at the step S14 is YES, that is, if there is an acute change in the frame power $R_0$ between the current frame and the temporally previous frame, control proceeds to a step S16, in order to set the noise flag to 0 and the current frame is set as being the voice sound frame. If the determination result is NO, that is, if a decision is that there is no acute change in the frame power $R_0$ between the current frame and the temporally previous frame, control proceeds to a step S15.

At the step S15, the frame power $R_0$ of a frame previous to the frame immediately previous to the current frame is subtracted from the frame power $R_0$ of the current frame, and it is checked whether the absolute value of the difference exceeds 3. The reason is that, if there is an acute change in the frame power $R_0$ between the current frame and the frame previous to the immediately previous frame, the current frame is set as being the voice sound frame. That is, if the determination result at the step S15 is YES, that is, if there is an acute change in the frame power $R_0$ between the current frame and the frame previous to the frame immediately previous to the current frame, control proceeds to a step S16, in order to set the noise flag to 0 and the current frame is set as being the voice sound frame. If the determination result is NO, that is, if a decision is that there is no acute change in the frame power $R_0$ between the current frame and frame previous to the frame immediately previous to the current frame, control proceeds to a step S17.

At the step S17, the noise flag is ultimately set to 0 or 1, and the corresponding information is supplied to the noise level detection circuit 5.

The noise level detection circuit 5 detects the voice sound level of the noise domain depending on the flag information obtained by the operation at the noise domain detection circuit 4 in accordance with the flow chart shown in FIGS. 5 and 6.

In detecting the noise domain or the noise level as described above, the noise reducing circuit may be used in combination with the above-described VSELP encoder 3, whereby the background noise level may be detected using output parameters of the VSELP encoder 3, such that only minute additional arrangement or additional signal processing for noise level detection suffices. On the other hand, if the noise reducing device is applied to a portable telephone device, the device enclosed in the telephone device for automatic adjustment of the received sound volume, not shown, may be used directly as the noise level detection circuit, so that there is no necessity of annexing a new dedicated circuit.

Figure 7:
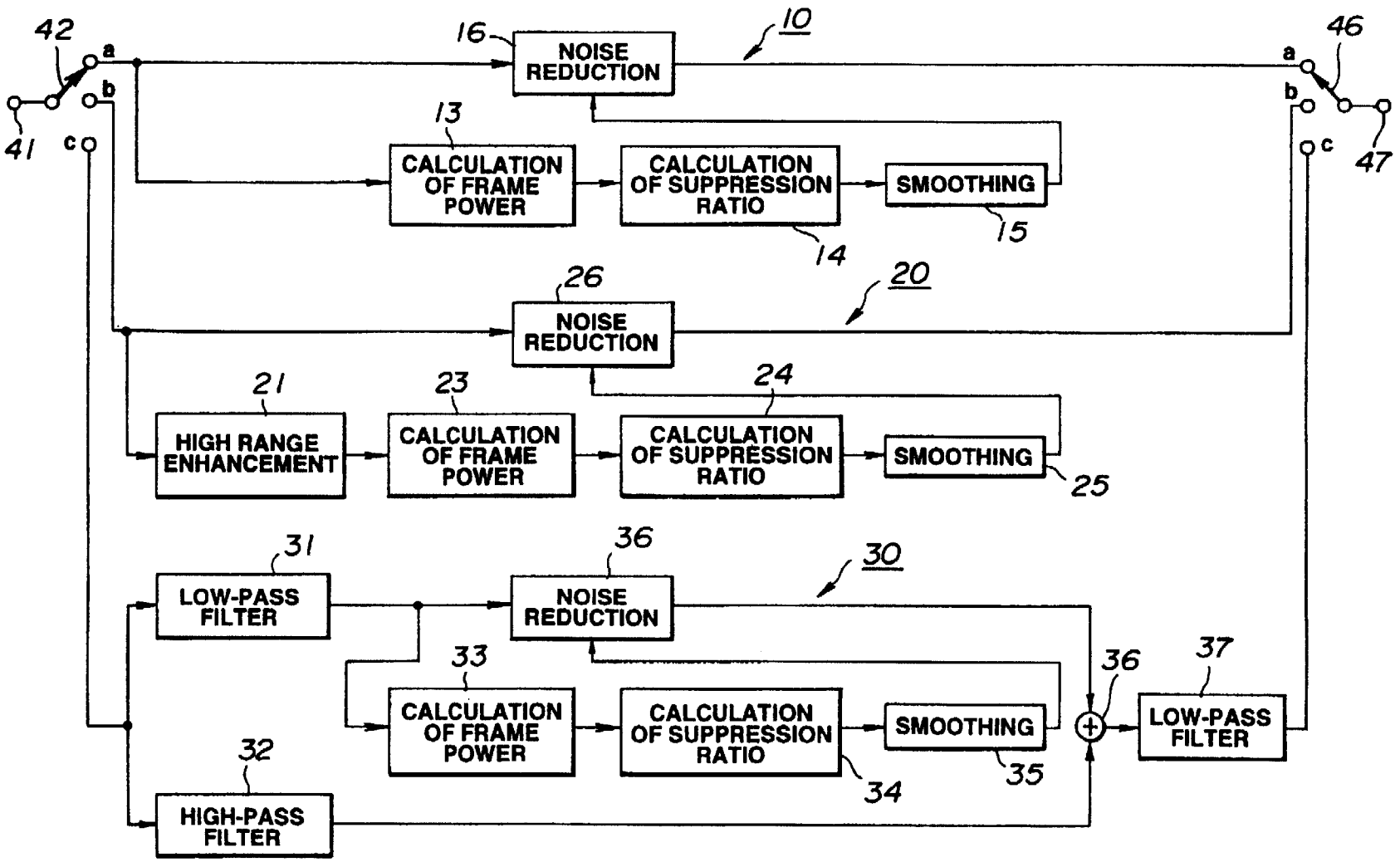
FIG. 7 is a block circuit diagram showing a noise reducing device for carrying out the noise reducing method according to a second embodiment of the present invention.

The noise reducing method according to a second embodiment of the present invention, in which a plurality of noise reducing algorithms are set in advance and switched in a controlled manner depending on the detected noise level, is hereinafter explained. FIG. 7 shows an arrangement of essential portions of the noise reducing device for carrying out the noise reducing method.

Referring to FIG. 7, there are shown circuits 10, 20 and 30 associated with respective different noise-reducing algorithms. One of these circuits 10, 20 and 30 is selected by changeover switches 42, 47 operatively connected to each other. The changeover switches 42, 47 are changed over in an interlocked manner by the changeover signal on the basis of the detected noise level so that one of the circuits 10, 20 and 30 is connected in circuit across an input terminal 41 and an output terminal 47. The input digital speech signal x(n) is supplied from the A/D converter 12 of FIG. 1 to the input terminal 41, while the output signal from the output terminal 47 is supplied to the VSELP encoder 3 shown in FIG. 4.

The first circuit 10 shown in FIG. 7 is a noise reducing circuit by the basic algorithm employing the circuits 13 to 16 shown in FIG. 1. The threshold value of the input level at the time of calculation in the suppression ratio calculating circuit 14 is set so as to be constant. The circuit 20 implements the algorithm for enhancing the high frequency domain of the input signal for the calculation of the noise suppression ratio, while the circuit 30 implements the algorithm of performing noise reduction only on the low frequency component of the input speech signal and summing the noise-reduced low-frequency component to the high-frequency component of the original input speech signal.

The circuit 10 is not explained since it is substantially the same as the first embodiment shown in FIG. 1 except that there is no necessity of providing for a variable threshold value of the input level for the calculation of the noise suppression ratio in the suppression ratio calculation circuit 14. The circuit 10 is connected between a fixed terminal a of the input side changeover switch 42 and a fixed terminal a of an output side changeover switch 46.

The circuit 20 calculates the noise suppression ratio using a signal resulting from high-frequency enhancement of the input digital signal x(n) from a fixed terminal b of the changeover switch 42. A high-frequency enhancement filter 21 is connected upstream of the frame power calculating circuit 23 for high-frequency enhancement. The consonants having a larger high-frequency energy are processed with only weak noise reduction.

If a filter output of the high-frequency enhancement filter 21 is expressed as y(n), the filter output y(n) becomes $$y(n)=2x(n)-x(n-1)$$

The frame power calculating circuit 23 calculates the frame power rms using the filter output y(n) in place of x(n) in equation (1).

The frame power rms calculated by the frame power calculating circuit 23 is supplied to a suppression ratio calculating circuit 24 so as to be used for the calculation of the suppression ratio value (scale) as in the above equation (2). The calculation of the suppression ratio value (scale) by the suppression ratio calculating circuit 24 is not explained since it is similar to that in the first embodiment explained previously.

The suppression ratio value obtained by the suppression ratio calculating circuit 24 is supplied via the smoothing circuit 25 to the noise reducing circuit 6.

The noise reducing circuit 6 multiplies the digital input signal x(n) from the fixed terminal b of the changeover switch 42, that is, the original input signal not processed with high-frequency enhancement, with the suppression ratio value supplied via the smoothing circuit 25, for reducing the noise in the input signal x(n), and transmits the noise-reduced output signal to a fixed terminal b of the changeover switch 46.

The circuit 20 performs the noise-reducing operation using the noise suppression ratio on the basis of the high-frequency-enhanced signal. Thus the noise-reducing operation becomes operative for the entire frequency spectrum of the input speech signal. However, the noise-reducing operation may be made to be effective only to a lesser extent on the consonant parts having the larger frequency side energy for diminishing the unnatural sound impression caused by the absence of the consonants.

The circuit 30 of FIG. 7 divides the frequency spectrum of the digital input signal x(n) from a fixed terminal c of the input side changeover switch 42 into a higher frequency range and a lower frequency range and performs a noise-reducing operation only on the low frequency component. The circuit 30 then sums the noise-reduced low-frequency component to the high-frequency component of the original input signal x(n) and transmits the resulting sum signal to a fixed terminal c of the output side changeover switch 46.

The circuit 30 has a low-pass filter 31 and a high-pass filter 32 connected in parallel to each other to a fixed terminal c of the changeover switch 42. The low-pass filter 31 and the high-pass filter transmit the low-frequency component and the high-frequency component of the digital input signal x(n), respectively. Only the low-frequency component is processed with the noise-reducing operation, while the high-frequency component is not processed in this manner. The reason is that the consonants with a small power are contained in the high-frequency component in a larger quantity than in the low-frequency component, such that, if the noise-reducing operation is performed on the high-frequency component, the consonants are simultaneously suppressed and hence the speech exhibiting an unnatural sound impression is produced.

If the filter output of the low-pass filter 31 is expressed as $y(n)_L$, the filter output $y(n)_L$ becomes $$y(n)_L = \frac{x(n) + x(n-1)}{2} \quad (5)$$

On the other hand, the filter output $y(n)_H$ becomes $$y(n)_H = \frac{x(n) - x(n-1)}{2} \quad (6)$$

The filter output $y(n)_L$ of the low-pass filter 31 is supplied to a frame power calculating circuit 33 and a noise-reducing circuit 36 similar to those shown in FIG. 1. That is, the frame power calculating circuit 33 calculates the mean frame power rms using the filter output $y(n)_L$ of the low-pass filter 31 in place of x(n) of the equation (1).

The mean frame power rms calculated by frame power calculating circuit 33 is supplied to the suppression ratio calculating circuit 34 so as to be used for calculating the suppression ratio value as in the equation (2). The explanation on calculation of the suppression ratio value by the calculating circuit 34 is not made to avoid redundancy.

The suppression ratio value, corrected as to the unnatural sound impression in the processed speech due to changes in the frame power, is transmitted to the noise reducing circuit 36 which multiplies the filter output $y(n)_L$ supplied from the low-pass filter 31 by the suppression ratio value supplied via the smoothing circuit 35 by way of performing noise reduction on the filter output $y(n)_L$ which is the low-frequency component of the input signal x(n). The noise-reduced output signal $y(n)_L$ is supplied to an additive node 36.

The additive node 36 is also fed with the filter output $y(n)_H$ of the high-pass filter 32. The additive node 36 adds the noise-reduced filter output $Y(n)_L$ to the non-noise-reduced filter output $y(n)_H$ and transmits the resulting sum signal to a low-pass filter 37.

The low-pass filter 37 is employed in order to prevent the sound of the high-frequency component from becoming pronounced inasmuch as the sum output $(Y(n)_L+y(n)_H)$ is the non-noise-reduced filter output. Specifically, the transfer function H(z) of the low-pass filter 37 becomes $$H(z) = \frac{1}{1 - \alpha Z^{-1}} \quad (7)$$

where $\alpha$ is a constant. The characteristics of the low-pass filter 37 are changed by changing the value of $\alpha$. The low-pass filter 37 transmits an output signal whose high frequency component is suppressed by filtering, that is, the noise-reduced output signal, to the fixed terminal c of the output side changeover switch 46.

In this manner, since the noise-reducing operation is performed only on the low-frequency component, while it is not performed on the high-frequency component where the consonant energy is thought to be higher, there is no risk of the consonant part being attenuated along with the noise, or of the high-frequency sound exclusively being enhanced, the playback sound may be produced which is susceptible only to extremely minute sound quality deterioration as compared to the original sound.

The changeover control signal for switching selection of the three circuits 10, 20 and 30 associated with the above-described three noise-reducing algorithms may be found by level discrimination with the aid of the two threshold values th1, th2, where th1>th2, using the level discrimination circuit 18 shown in FIG. 1, on the basis of the noise level A from the noise level detection circuit 5 shown in FIG. 4.

Thus it suffices to select the fixed terminal a and hence the circuit 10, the fixed terminal b and hence the circuit 20, and the fixed terminal c and hence the circuit 30, for A≧th1, th1>A≧th2 and for th2>A, respectively.

It becomes possible in this manner to intensify the noise-reducing operation for the larger background noise and to weaken the noise-reducing operation for the lower background noise, in order to suppress the unnatural sound impression.

The present invention is not limited to the above-described first and second embodiments. For example, it is possible to provide for a plurality of noise-reducing algorithms of a plurality of input/output characteristics having different profiles of input/output characteristic curves and to select one of the algorithms of the different input/output characteristics responsive to the changeover control signal based upon the noise level. On the other hand, various other speech encoders than the above-described VSELP encoder, such as the multi-pulse excited linear prediction speech encoder, as explained in JP Patent Kokai (Laid-Open) Publication 60-70500 (1985), may be employed. In addition, the noise reducing device for carrying out the noise reducing method according to the present invention may find use in other than the portable telephone device.

What is claimed is:

1. A method for reducing noise contained in an input speech signal comprising steps of:

detecting a level of a noise component in the input speech signal and forming a control signal based on the detected noise level; and modifying steps taken in performing a noise reducing operation on the input speech signal for carrying out a modified noise reducing operation based on the control signal, wherein the noise reducing operation includes carrying out level expansion to produce different effects with a predetermined threshold value of an input speech signal level as a boundary, modifying the threshold value based on the control signal, and diminishing the level expansion effect when the input speech signal level is less than or equal to the threshold value such that the level expansion effect for an input speech signal level above the threshold value is greater than the level expansion effect for an input speech signal level below the threshold value and a graph of an output speech signal level as ordinate data as a function of the input speech signal level as abcissa data shows a greater slope above the threshold value and a relatively lesser slope below the threshold value.

2. The method as claimed in claim 1, wherein the noise reducing operation includes carrying out the level expansion to give different effects for a plurality of threshold values of the input speech signal level being respective boundaries such that the level expansion of intermediate input speech signal levels is greater than the level expansion of low input speech signal levels and the level expansion of high input speech signal levels is less than the level expansion of intermediate input speech signal levels and a graph of the output speech signal level as ordinate data as a function of the input speech signal level as abcissa data shows a greater slope at the intermediate input speech signal levels and a relatively lesser slope at low input speech signal levels and at high input speech signal levels.

3. The method as claimed in claim 1, further comprising steps of:

detecting a mean power of the input speech signal for each of a plurality of unit time durations for use as the input speech signal level;

setting a signal suppression ratio based on the detected input speech signal level and the control signal; and carrying out the noise reducing operation by multiplying the input speech signal with the signal suppression ratio.

4. The method as claimed in claim 3, further comprising a step of:

smoothing the signal suppression ratio within each of the plurality of unit time durations.

5. The method as claimed in claim 4, further comprising a step of:

enhancing an effect of smoothing the signal suppression ratio when the detected input speech signal level is lower than a level of the input speech signal during a previous one of the plurality of unit time durations.

6. The method as claimed in claim 1, wherein the step of modifying includes a step of:

selecting one of a plurality of processing algorithms based on the control signal.

7. The method as claimed in claim 6, wherein the plurality of processing algorithms include:

a first noise reducing algorithm for calculating a first suppression ratio based on the input speech signal level and multiplying the input speech signal with the calculated first suppression ratio;

a second noise reducing algorithm for calculating a second suppression ratio based on the level of a signal corresponding to the input speech signal whose high-frequency component is enhanced and multiplying the input speech signal with the calculated second suppression ratio; and a third noise reducing algorithm for performing a noise reducing operation only on a low-frequency component of the input speech signal and adding the noise-reduced low-frequency component to the high-frequency component of the input speech signal.

8. The method as claimed in claim 1, further comprising a step of:

compression encoding the input speech signal and detecting the level of the noise component in the input speech signal at the noise level detecting step using encoding parameters obtained by the compression encoding step.

9. An apparatus for reducing noise in an input speech signal having a microphone for receiving the input speech signal and noise reducing means for reducing noise contained in the input speech signal received by the microphone, the apparatus comprising:

noise level detection means for detecting a level of a noise component in the input speech signal and outputting a control signal based on the detected noise level;

modifying means for modifying steps performed in a noise reducing operation for the input speech signal based on the control signal;

speech level detection means for detecting a level of the input speech signal, whereby the noise reducing means carries out level expansion to give different effects with a predetermined threshold value of the input speech signal level as a boundary and modifies the threshold value responsive to the control signal; and means for diminishing the level expansion effect for the input speech signal when the level detected by the speech level detection means is less than or equal to the threshold value such that the level expansion effect for an input speech signal level above the threshold value is greater than the level expansion effect for an input speech signal level below the threshold value and a slope of a curve of an output speech signal level plotted as a function of the input speech signal level is greater above the threshold value and is relatively less below the threshold value.

10. The apparatus as claimed in claim 9, further comprising:

level expansion means for performing level expansion to give a different level expansion effect for each of a plurality of threshold values of the input speech signal level such that the level expansion of intermediate input speech signal levels is greater than the level expansion of low input speech signal levels and the level expansion of high input speech signal levels is less than the level expansion of intermediate input speech signal levels and a slope of a curve of the output speech signal level plotted as a function of the input speech signal level is greater at the intermediate input speech signal levels and is less at low input speech signal levels and at high input speech signal levels.

11. The apparatus as claimed in claim 9, further comprising:

means for detecting a mean power of the input speech signal for each of a plurality of unit time durations for use as the input speech signal level;

signal suppression ratio setting means for setting a signal suppression ratio based on the detected input speech signal level and the control signal; and arithmetic-logical means for multiplying the input speech signal with the signal suppression ratio in order to carry out a noise reducing operation.

12. The apparatus as claimed in claim 11, further comprising:

smoothing means for receiving the signal suppression ratio and smoothing the received signal suppression ratio within each of the plurality of unit time durations.

13. The apparatus as claimed in claim 12, wherein the smoothing means enhances a smoothing effect when the detected input speech signal level is lower than the input speech signal level during a previous one of the plurality of unit time durations.

14. The apparatus as claimed in claim 9, further comprising:

selecting means for selecting a selected algorithm from among a plurality of processing algorithms based on the control signal and outputting the selected algorithm to the modifying means for use in the noise reducing operation.

15. The apparatus as claimed in claim 14, wherein the plurality of processing algorithms include:

a first noise reducing algorithm for calculating a first suppression ratio based on the level of the input speech signal level and multiplying the input speech signal with the calculated first suppression ratio;

a second noise reducing algorithm for calculating a second suppression ratio based on the level of a signal corresponding to the input speech signal whose high-frequency component is enhanced and multiplying the input speech signal with the calculated second suppression ratio; and a third noise reducing algorithm for performing a noise reducing operation only on the low-frequency component of the input speech signal and adding the noise-reduced low-frequency component to the high-frequency component of the input speech signal.

16. The apparatus as claimed in claim 9, further comprising:

speech compression encoding means for compression encoding the input speech signal, the noise level detection means detecting the level of the noise component in the input speech signal using encoding parameters obtained from the speech compression encoding means.

17. A telephone apparatus having a microphone to which a speech signal is input, a noise reducing circuit for reducing noise contained in the speech signal input to the microphone and a transmitter for transmitting signals produced by the noise reducing circuit, the telephone apparatus comprising:

noise level detecting means for detecting a level of the noise component in the input speech signal;

means for generating and outputting a control signal based on the detected noise level;

speech level detection means for detecting a level of the input speech signal, whereby the noise reducing means carries out level expansion to give different effects with a predetermined threshold value of the input speech signal level as a boundary and modifies the threshold value based on the control signal; and means for diminishing the level expansion effect of the input speech signal when the level detected by the speech level detection means is less than or equal to the threshold value such that the level expansion effect for an input speech signal level above the threshold value is greater than the level expansion effect for an input speech signal level below the threshold value and a slope of a curve of an output speech signal level plotted as a function of the input speech signal level is greater above the threshold value and is less below the threshold value.

* * * * *